US005954097A

United States Patent [19]

Boutilier

[11] Patent Number: 5,954,097

[45] **Date of Patent: *Sep. 21, 1999**

[54] PAPERMAKING FABRIC HAVING BILATERALLY ALTERNATING TIE YARNS

[75] Inventor: Glenn David Boutilier, Cincinnati, Ohio

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/696,712

[22] Filed: Aug. 14, 1996

[51] Int. Cl.[6] ..... D03D 3/00

[52] U.S. Cl. ..... 139/383 A; 428/131; 428/135; 428/137

[58] Field of Search ..... 428/131, 247, 428/257; 139/383 A

[56] References Cited

U.S. PATENT DOCUMENTS

| | | | |
|---|---|---|---|
| 4,514,345 | 4/1985 | Johnson et al. . | |
| 4,528,239 | 7/1985 | Trokhan . | |
| 4,529,480 | 7/1985 | Trokhan . | |
| 4,637,859 | 1/1987 | Trokhan . | |
| 4,945,952 | 8/1990 | Vöhringer . | |
| 4,974,642 | 12/1990 | Taipale | 139/383 A |
| 4,989,648 | 2/1991 | Tate et al. . | |
| 4,995,428 | 2/1991 | Tate et al. . | |
| 5,052,448 | 10/1991 | Givin | 139/383 A |
| 5,102,725 | 4/1992 | Knox et al. | 139/383 A |
| 5,152,327 | 10/1992 | Vohringer | 139/383 A |
| 5,334,289 | 8/1994 | Trokhan et al. . | |
| 5,454,405 | 10/1995 | Hawes . | |
| 5,482,566 | 1/1996 | Barreto | 139/383 A |
| 5,496,624 | 3/1996 | Stelljes et al. | 139/383 A |
| 5,566,724 | 10/1996 | Trokhan et al. | 139/383 A |

FOREIGN PATENT DOCUMENTS

| | | |
|---|---|---|
| 279 214 | 8/1988 | Germany . |
| WO 91/14813 | 10/1991 | WIPO . |
| WO 93/10304 | 5/1993 | WIPO . |

*Primary Examiner*—Andy Falik

*Attorney, Agent, or Firm*—Vladimir Vitenberg; Larry L. Huston; E. Kelly Linman

[57] ABSTRACT

A papermaking belt comprising a top (web facing) layer of interwoven top layer yarns, a bottom (machine facing) layer of interwoven bottom layer yarns, and a plurality of tie yarns. The top layer yarns comprise a plurality of top layer carrier yarns interwoven in a weave with a plurality of top layer cross-carrier yarns, the top layer carrier yarns being perpendicular to the top layer cross-carrier yarns. The bottom layer yarns comprise a plurality of bottom layer carrier yarns interwoven in a weave with a plurality of bottom layer cross-carrier yarns, the bottom layer carrier yarns being perpendicular to the bottom layer cross-carrier yarns. The top layer and the bottom layer are tied together in a parallel and interfacing relationship by a plurality of tie yarns having a general direction of the top layer carrier yarns and passing over the top layer cross-carrier yarns and under the bottom layer cross-carrier yarns in a repeating pattern. As each of the tie yarns passes over at least one of the top layer cross-carrier yarns and under at least one of the bottom layer cross-carrier yarns, each of the tie yarns bilaterally alternates about one top layer carrier yarn in the direction of the top layer cross-carrier yarns whereby forming an undulating line passing at spaced intervals completely underneath that top layer carrier yarn about which each of the tie yarns alternates.

20 Claims, 10 Drawing Sheets

PAPERMAKING FABRIC HAVING BILATERALLY ALTERNATING TIE YARNS

FIELD OF THE INVENTION

The present invention is related to papermaking bets useful in papermaking machines for making strong, soft, absorbent paper products. More particularly, this invention is concerned with papermaking fabrics, or belts, comprised of two layers.

BACKGROUND OF THE INVENTION

Paper products are used for a variety of purposes. Paper towels, facial tissues, toilet tissues, and the like are in constant use in modern industrialized societies. The large demand for such paper products has created a demand for improved versions of the products.

Generally, the papermaking process includes several steps. An aqueous dispersion of the papermaking fibers is formed into an embryonic web on a foraminous member, such as Fourdrinier wire, or a twin wire paper machine, where initial dewatering and fiber rearrangement occurs.

In a through-air-drying process, after the initial dewatering, the embryonic web is transported to a through-air-drying belt comprising an air pervious deflection member. The deflection member may comprise a patterned resinous framework having a plurality of deflection conduits through which air may flow under a differential pressure. The resinous framework is joined to and extends outwardly from a woven reinforcing structure. The papermaking fibers in the embryonic web are deflected into the deflection conduits, and water is removed through the deflection conduits to form an intermediate web. The intermediate web is then dried at the final drying stage, similarly to the conventional papermaking described above. At the final drying stage, the portion of the web registered with the resinous framework may be subjected to imprinting—to form a multi-region structure.

Through-air-drying paper webs are made as described in commonly assigned U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,334,289 issued to Trokhan et al on Aug. 2, 1994. The foregoing patents are incorporated herein by reference for the purpose of showing preferred constructions of patterned resinous framework and reinforcing structure type through-air-drying belts. Such belts have been used to produce commercially successful products such as Bounty paper towels and Charmin Ultra toilet tissue, both produced and sold by the instant assignee.

The woven reinforcing structure of the through-air-drying belts stabilizes and strengthens the resinous framework and reduces the permeability of the papermaking belt. Therefore, the reinforcing structure must have a suitable projected open area in order to allow the vacuum dewatering machinery employed in the papermaking process to adequately perform its function of removing water from the intermediate web, and to permit water removed from the web to pass through the papermaking belt. Therefore, the reinforcing structure should be highly permeable to fluids such as air and water.

At the same time, the reinforcing structure also serves an important function of supporting the cellulosic fibers, not allowing them be completely separated from each other or to be blown through the papermaking belt as a result of application of a vacuum pressure. These phenomena cause pin-sized holes, or pinholes, in the paper web. A large amount of pinholes reduces the quality of the paper web and may negatively affect the consumers' perception of the paper product. Therefore, the amount of fiber support provided by the reinforcing structure is of primary importance. Generally, a trade-off exists between the air permeability and fiber support of a papermaking belt. This trade-off is especially sensitive in through-air-drying belts which must have adequate open area for removing water from the web through the papermaking belt. Improvement in the fiber support of a belt by reducing its projected open area reduces the air permeability of the belt, or, vice versa, improvement in the air permeability of the belt by increasing its projected open area reduces the fiber support of the belt.

In order to mitigate the negative consequences of this trade-off between the air permeability and the fiber support of a papermaking belt, the early through-air-drying belts comprised a fine mesh reinforcing element. While such a fine mesh provided an acceptable fiber support, it was generally impractical because it did not provide necessary seam strength and resistance to the high temperatures encountered in papermaking.

A new generation of through-air-drying papermaking belts addressed these concerns. In these belts, a dual layer reinforcing structure significantly improved the seam strength and durability of the belts. In some dual layer reinforcing structures, a single cross-machine direction yarn system ties two machine direction yarn layers together, with the result of having vertically stacked machine direction yarns.

The use of a triple layer belt further improves a fiber support of the reinforcing structure. A triple layer belt comprises two completely independent woven layers, a top layer and a bottom layer, each having its own machine direction yarns interwoven with its own cross-machine direction yarns. The two independent woven elements are tied together with tie yarns.

Preferably, the top, or web-facing layer of the triple layer belt, has a finer mesh than the bottom, or machine-facing layer. The finer mesh provides a better fiber support and minimizes the amount of pinholes. The bottom layer utilizes coarser yarns to increase rigidity and improve seam strength. In a triple layer belt, the tie yarns may be specifically added to perform the function of linking the two independent layers together, without being present in either layer as a part of its inherent structure. Alternatively, the tie yarns may be the integral yarns forming the top and/or bottom layers of the reinforcing structure. In both cases, the tie yarns may be oriented in either the machine direction or the cross machine direction. Machine direction tie yarns are preferred because of the increased seam strength they provide.

European patent WO 91/14813 issued to Wright on Oct. 3, 1991 and assigned to Asten Group, Inc., describes a two-ply forming fabric having an upper paper carrying layer comprising twice as many cross-machine direction yarns as the lower, machine side, layer. A system of machine direction yarns interweaves in a selected pattern such that a zigzag effect is produced on the underside of the fabric to provide improved drainage.

U.S. Pat. No. 5,454,405 issued to Hawes on Oct. 3, 1995 and assigned to Albany International Corp. describes a triple-layer papermaking fabric having a system of top weft yarns and a system of bottom weft yarns interwoven with paired first and second warp yarns. The second warp yarns have relatively little crimp which increases stretch resistance in the fabric.

Although the use of double layer and triple layer reinforcing structures helps to balance the trade-off between the fiber support and the air permeability of the belt, the use of double and triple layer structures cannot, by itself, decouple these inherently interconnected characteristics.

Accordingly, it is an object of the present invention to provide an improved papermaking belt which substantially reduces the negative consequences of the trade-off between the air permeability and the fiber support of the belt. It is a purpose of the present invention to increase the available air permeability of the belt at constant fiber support, or to increase the available fiber support of the belt at constant air permeability.

SUMMARY OF THE INVENTION

A papermaking fabric of the present invention is comprised of three primary elements: a top layer of interwoven top layer yarns, a bottom layer of interwoven bottom layer yarns, and a plurality of tie yarns. In its preferred embodiment, the papermaking fabric is a flat-woven endless belt which has a web-facing side and a machine-facing side opposite the web-facing side.

The papermaking fabric of the present invention may also have a resinous framework joined to the papermaking fabric and extending outwardly from the web-facing side of the top layer to form a web-contacting surface of the papermaking fabric.

The top layer yarns comprise a plurality of top layer carrier yarns interwoven in a weave with a plurality of top layer cross-carrier yarns. The top layer carrier yarns are substantially perpendicular to the top layer cross-carrier yarns. Preferably, the plurality of top layer carrier yarns are oriented in the machine direction. Alternatively, the plurality of top layer carrier yarns may be oriented in the cross-machine direction.

The bottom layer yarns comprise a plurality of bottom layer carrier yarns interwoven in a weave with a plurality of bottom layer cross-carrier yarns. The bottom layer carrier yarns are substantially perpendicular to the bottom layer cross-carrier yarns. Preferably, the plurality of bottom layer carrier yarns are oriented in the machine direction.

The top layer and the bottom layers are tied together in a substantially parallel and interfacing relationship by a plurality of tie yarns having the same general direction as the plurality of top layer carrier yarns. The tie yarns may comprise adjunct tie yarns. Adjunct tie yarns are not inherent in the weave of either the top layer or the bottom layer and are used only for the purposes of joining the top layer and the bottom layer. Alternatively, the tie yarns may comprise integral tie yarns. The integral tie yarns are in the weave of the top layer and/or the bottom layer. The integral tie yarns may be top-integral tie yarns, bottom-integral tie yarns, or top/bottom-integral tie yarns. The tie yarns pass over the top layer cross-carrier yarns and under the bottom layer cross-carrier yarns in a repeating pattern such that each of the plurality of tie yarns passes at spaced intervals over at least one of the top layer cross-carrier yarns and under at least one of the bottom layer cross-carrier yarns.

As the tie yarns pass over the top layer cross-carrier yarns and under the bottom layer cross-carrier yarns, each of the tie yarns bilaterally alternates about at least one of the top layer carrier yarns and/or at least one of the bottom layer carrier yarns. Each of the tie yarns alternates in the direction of the top layer cross-carrier yarns. As a result of this bilateral alternation, each of the tie yarns forms an undulating line passing completely underneath at least one of the top layer carrier yarns, about which this tie yarns alternates, at spaced intervals intermediate two adjacent maxima of bilateral alternation of each of the tie yarns.

BRIEF DESCRIPTION OF THE DRAWINGS

FIGS. 2–3 show the resinous framework in phantom.

DETAILED DESCRIPTION OF THE INVENTION

Figure 1:
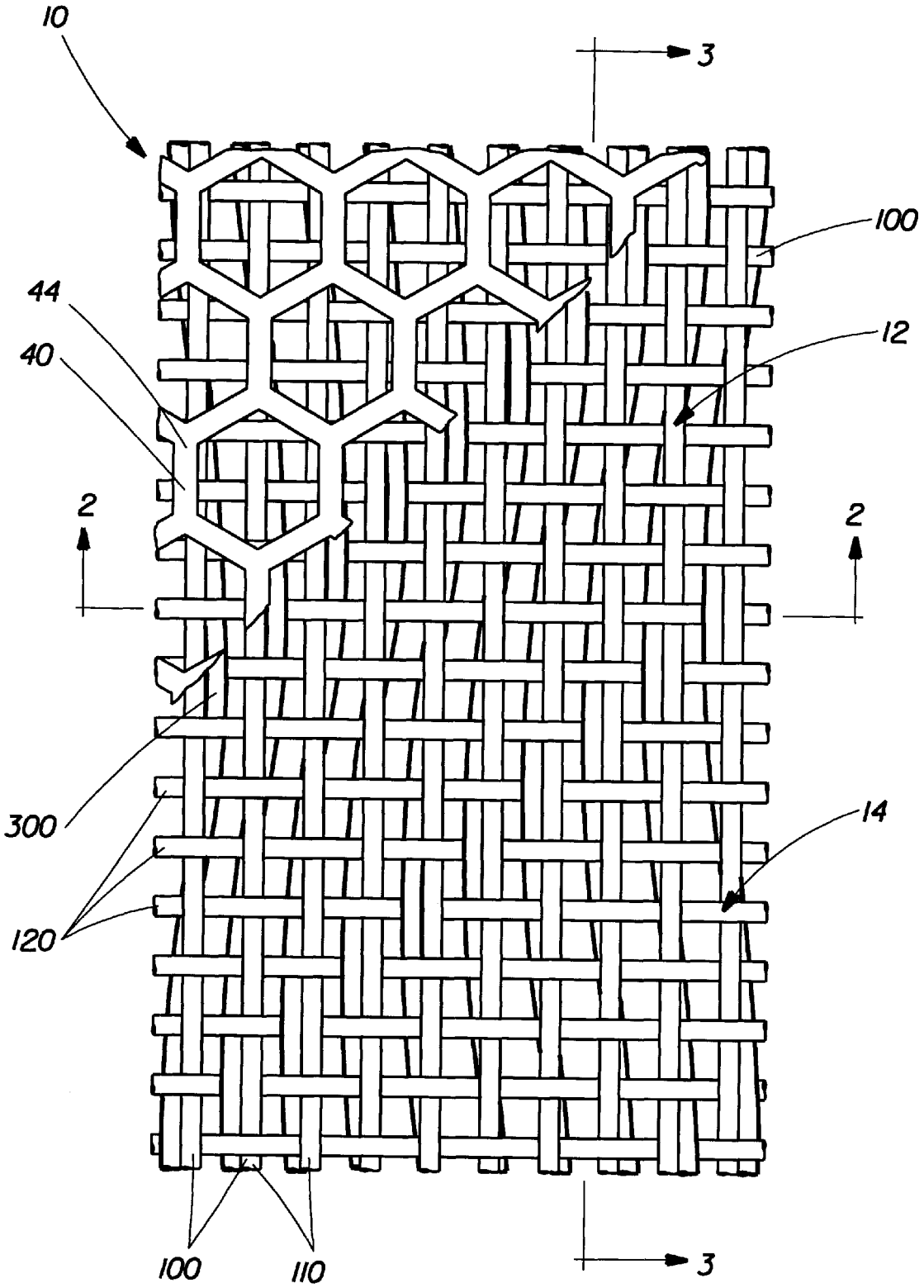
FIG. 1 is a fragmentary top plan view of a papermaking fabric according to the claimed invention, having adjunct tie yarns and a framework, and shown partially in cutaway for clarity. The bottom layer is not shown for clarity.

Referring to FIGS. 1–11, the papermaking fabric 10 of the present invention preferably comprises a flat-woven endless belt which carries a web of cellulosic fibers from a forming wire to a drying apparatus, typically a heated drum, such as a Yankee drying drum (not shown). Although the preferred embodiment of the papermaking fabric 10 is in the form of an endless belt, it can be incorporated into numerous other forms which include, for instance, statutory plates for use in making handsheets or rotating drums for use with other types of continuous or batch processes. As used hereinafter, the term "papermaking belt" (or simply "belt") is synonymous to the term "papermaking fabric" (or simply, "fabric").

The papermaking belt 10 of the present invention comprises three primary elements: a top layer 12 of interwoven top layer yarns 100, a bottom layer 20 of interwoven bottom layer yarns 200, a plurality of tie yarns 300. The top layer 12 is a web facing layer, and the bottom layer 20 is a machine facing layer of the belt 10. As will be discussed in greater detail below, the terms and numeric references "top layer yarns 100," "bottom layer yarns 200," "tie yarns 300" are generic terms and numeric references which include and designate different types of top layer yarns, bottom layer yarns, tie yarns, respectively.

Figure 2:
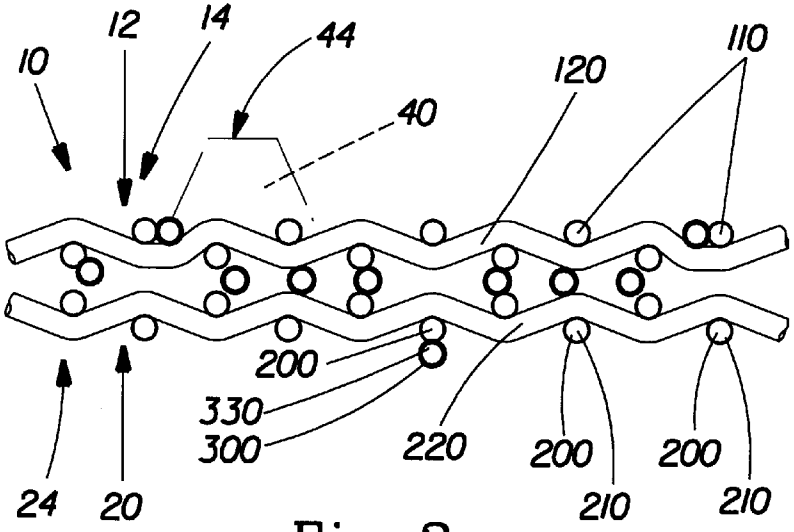
FIG. 2 is a vertical cross-sectional view taken along line 2—2 of FIG. 1, showing an element of the framework and the adjunct tie yarns forming undulating lines passing completely underneath the top layer carrier yarns and the bottom layer carrier yarns.
Figure 3:
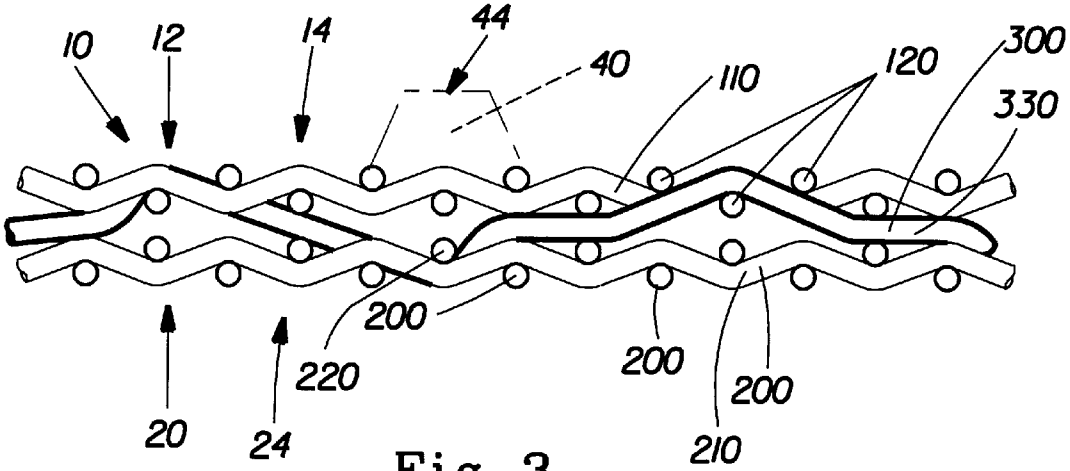
FIG. 3 is a vertical cross-sectional view taken along line 3—3 of FIG. 1.
Figure 4:
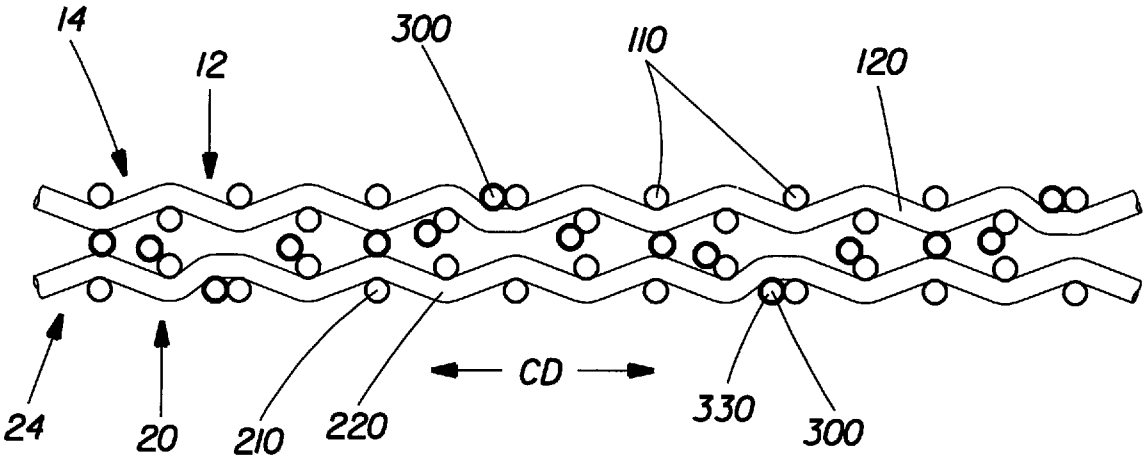
FIG. 4 is a vertical cross-sectional view of the papermaking fabric according to the claimed invention, showing the adjunct tie yarns forming undulating lines passing completely underneath only the top layer carrier yarns.
Figure 5:
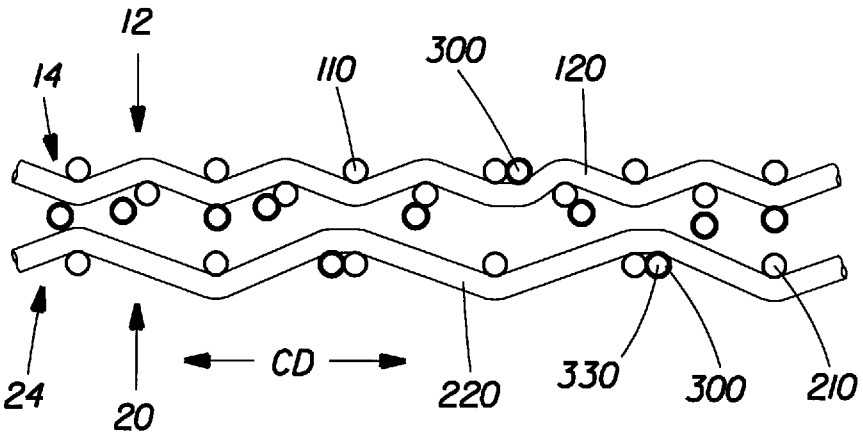
FIG. 5 is a vertical cross-sectional view of the papermaking fabric according to the claimed invention, having fewer bottom layer carrier yarns than top layer carrier yarns.
Figure 6:
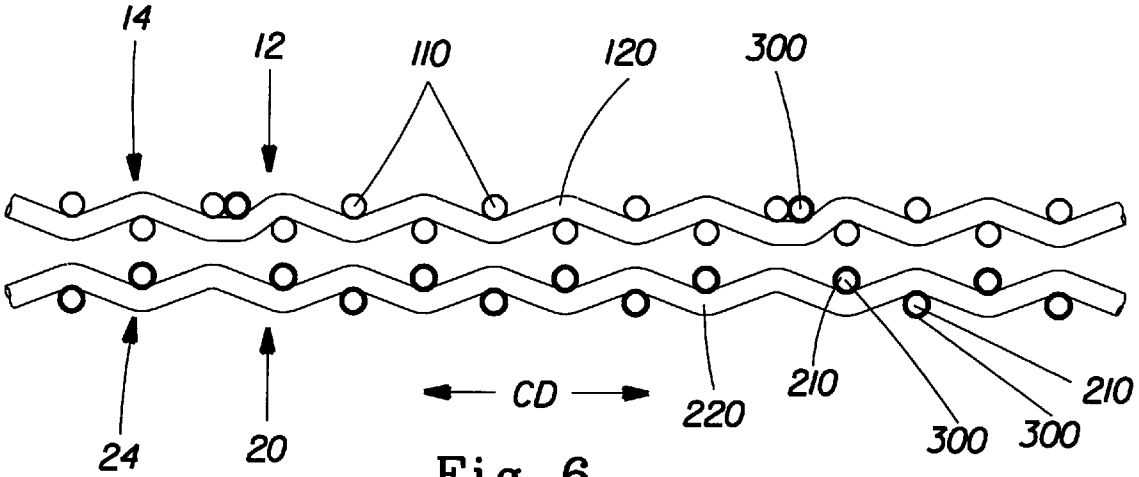
FIG. 6 is a vertical cross-sectional view of the papermaking fabric according to the claimed invention, showing the bottom-integral tie yarns.

Referring now to FIGS. 1–3, the top layer 12 has a web facing side 14, and the bottom layer 20 has a machine facing side 24. The belt 10 may comprise a framework 40 joined to the belt 10 and extending outwardly from the web facing side 14 of the top layer 12 to form a web-contacting surface 44. Preferably, the framework 40 is cast from a photosensitive resin onto the top layer 12.

When made from a photosensitive resin, the framework 40 penetrates the structure of the belt 10 and is cured into any desired pattern by irradiating liquid resin with actinic radiation through a binary mask having opaque sections and transparent sections. A variety of suitable resins can be used as the framework 40. The aforementioned U.S. Pat. No. 4,529,480; U.S. Pat. No. 4,514,345; U.S. Pat. No. 4,528,349, U.S. Pat. No. 5,334,289, describing the framework 40 in greater detail, are incorporated herein by reference.

The top layer yarns 100 of the papermaking belt 10 are comprised of a plurality of top layer carrier yarns 110 interwoven in a weave with a plurality of top layer cross-carrier yarns 120. The top layer carrier yarns 110 are substantially perpendicular to the top layer cross-carrier yarns 120. FIG. 1 shows a preferred one-over/one-under square weave of the top layer yarns 100, but it is to be recognized that other weaves may be utilized. The examples of the suitable weave patterns include, but are not limited to full twill, broken twill, semi-twill, and multi-shed satins.

Similarly to the top layer yarns 100, the bottom layer yarns 200 are comprised of a plurality of bottom layer carrier yarns 210 interwoven in a weave with a plurality of bottom layer cross-carrier yarns 220, the bottom layer carrier yarns 210 being substantially perpendicular to the bottom layer cross-carrier yarns 220. Preferably, but not necessarily, the bottom layer 20 has a square weave, in order to maximize seam strength. As used herein, top layer yarn 100 is generic to and inclusive of the top layer carrier yarns 110 and the top layer cross-carrier yarns 120. Analogously, bottom layer yarn 200 is generic to and inclusive of the bottom layer carrier yarns 210 and the bottom layer cross-carrier yarns 220.

It is preferred that the top layer carrier yarns 110 and the bottom layer carrier yarns 210 have a machine direction. Alternatively, the top layer carrier yarns 110 and the bottom layer carrier yarns 210 may have a cross-machine direction. As one skilled in the art will recognize, the term "machine direction" refers to that direction which is parallel to the principal flow of the paper web through the papermaking apparatus. The "cross-machine direction" is perpendicular to the machine direction and lies within the plane of the belt 10. The machine direction of the carrier yarns 110, 210 is preferred to maximize seam strength of the belt 10. However, arrangements having the carrier yarns 110, 210 disposed in the cross-machine direction may also be utilized.

Figure 7:
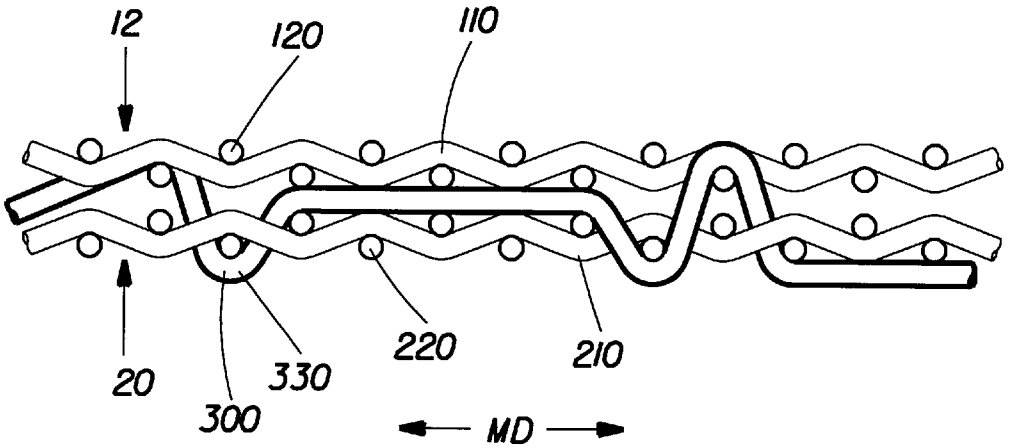
FIG. 7 is a vertical cross-sectional view perpendicular to the view shown in FIG. 2, showing the adjunct tie yarns forming undulating lines passing completely underneath the top layer carrier yarns and the bottom layer carrier yarns.
Figure 8:
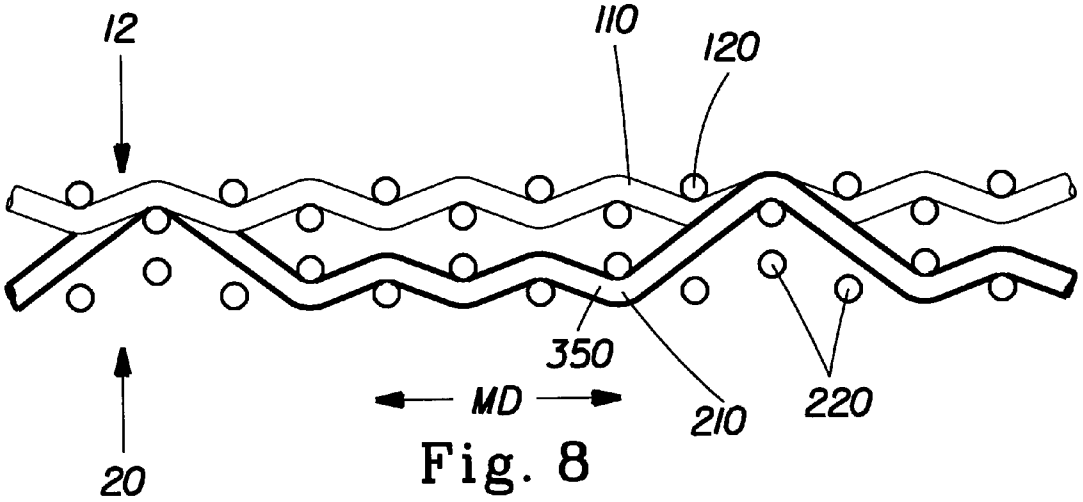
FIG. 8 is a vertical cross-sectional view similar to the view shown in FIG. 3, showing a bottom-integral tie yarns passing completely underneath a top layer carrier yarn and forming a "one-over/seven-under" repeating pattern of the tie layers interwoven with the top layer.
Figure 9:
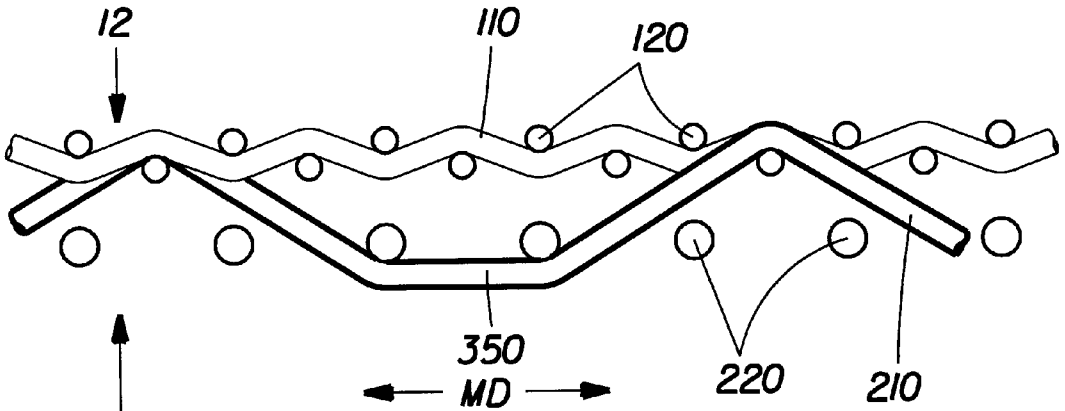
FIG. 9 is a vertical cross-sectional view similar to the view shown in FIG. 8 and showing another embodiment of the bottom-integral tie yarn.

As shown in FIGS. 2–11, the top layer 12 and the bottom layer 20 are tied together in a substantially parallel and interfacing relationship by the plurality of tie yarns 300. Preferably, the top layer 12 and the bottom layer 20 are tied together in an abutting relationship. If desired, as FIG. 2 shows, each top layer carrier yarn 110 is stacked in a vertical alignment with one bottom layer carrier yarn 210; and as FIG. 3 shows, each top layer cross-carrier yarn 120 is stacked in a vertical alignment with one bottom layer cross-carrier yarn 220. Although the embodiment having a vertical alignment is preferred, it is not necessary. For example, only the carrier yarns 110, 210 may be stacked in a vertical alignment, while the cross-carrier yarns 120, 220 are not, or vice versa. Also, the top layer 12 and the bottom layer 20 my be slightly displaced relative each other from the vertical alignment in the direction of carrier yarns 110, 210, or in the direction of cross-carrier yarns 120, 220. The top layer 12 may have the top layer yarns 100 which are spaced more closely than the bottom layer yarns 200 are—to provide a sufficient fiber support. FIG. 9 represents the embodiment in which every second top layer cross-carrier yarn 120 has and is stacked in a vertical alignment with one bottom layer cross-carrier yarn 220.

Figure 1A:
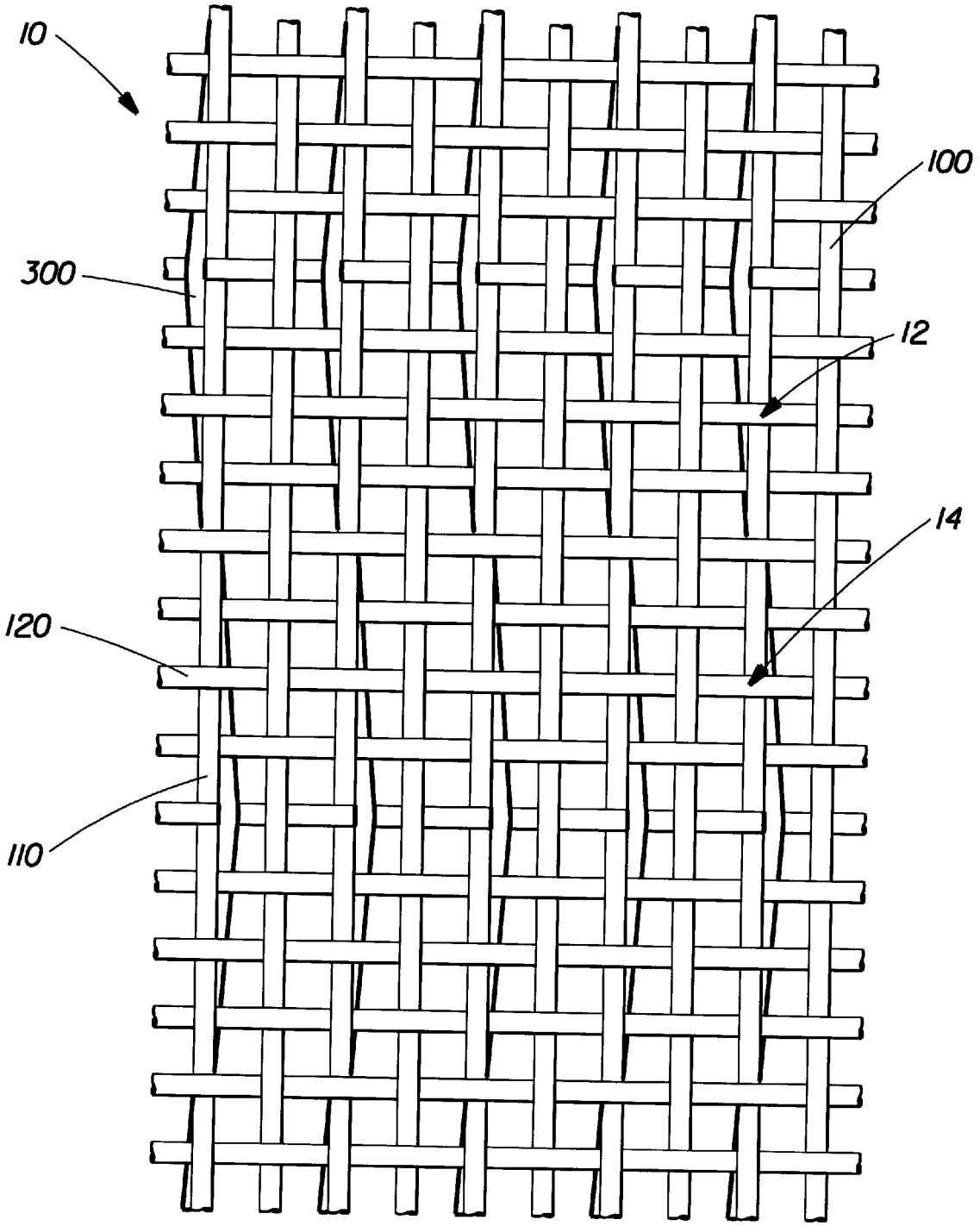
FIG. 1A is a top plan view of a papermaking fabric, similar to FIG. 1, but having a more homogeneous distribution of maxima of bilateral alternation than the papermaking fabric illustrated in FIG. 1.

As best seen in FIGS. 1 and 1A, the tie yarns 300 have the same general direction as the top layer carrier yarns 110. It will be noted that, for the purposes of illustration, the tie yarns 300 have been shaded in FIGS. 1–11 and 13. As FIG. 1 shows, the tie yarns 300 pass over some of the top layer cross-carrier yarns 120 in a repeating pattern. The repeating pattern is formed by the plurality of tie yarns 300 as each tie yarn 300 passes at spaced intervals over at least one of the top layer cross-carrier yarns 120 and under at least one of the bottom layer cross-carrier yarns 220. (The bottom layer cross-carrier yarns are not shown in FIG. 1 for clarity.) With regard to the top layer 12, the spaced interval shown in FIGS. 1 and 1A includes eight top layer cross-carrier yarns 120. In other words, inasmuch as the individual tie yarn 300 is concerned, the repeating pattern shown in FIGS. 1 and 1A is formed by each individual tie yarn 300 passing over one top layer cross-carrier yarn 120, then passing under seven top layer cross-carrier yarns 120, then passing over one top layer cross-carrier yarn 120, then again passing under seven top layer cross-carrier yarns 120, and so on (i.e., a "one-over/seven-under" pattern). As best seen in FIG. 3, when the tie yarn 300 passes under seven top layer cross-carrier yarns 120, the tie yarn 300 also passes under at least one of the bottom layer cross-carrier yarns 220, thereby joining the top layer 12 and the bottom layer 20 together.

Figure 10:
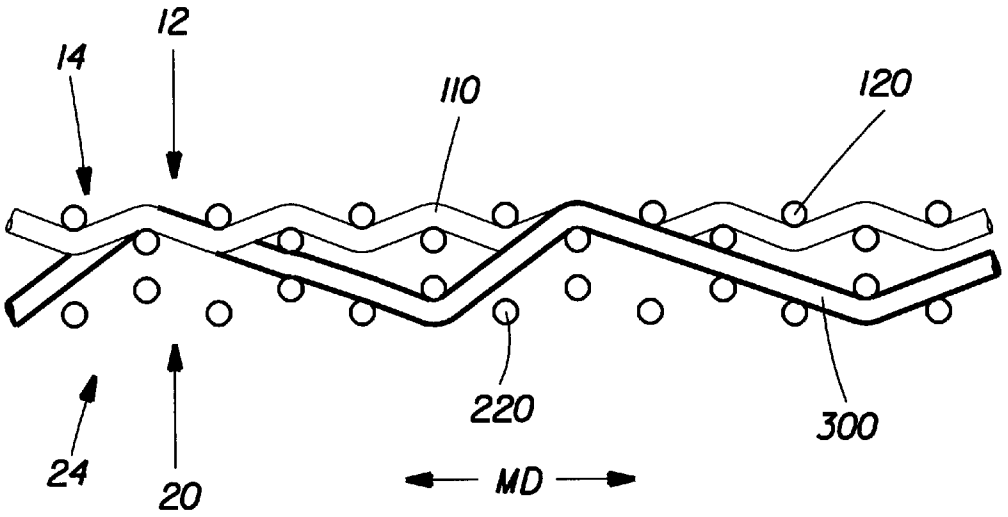
FIG. 10 is a vertical cross-sectional view similar to the view shown in FIG. 8, showing another embodiment of the bottom-integral tie yarn forming a "one-over/five-under" repeating pattern of the tie layers interwoven with the top layer.
Figure 11:
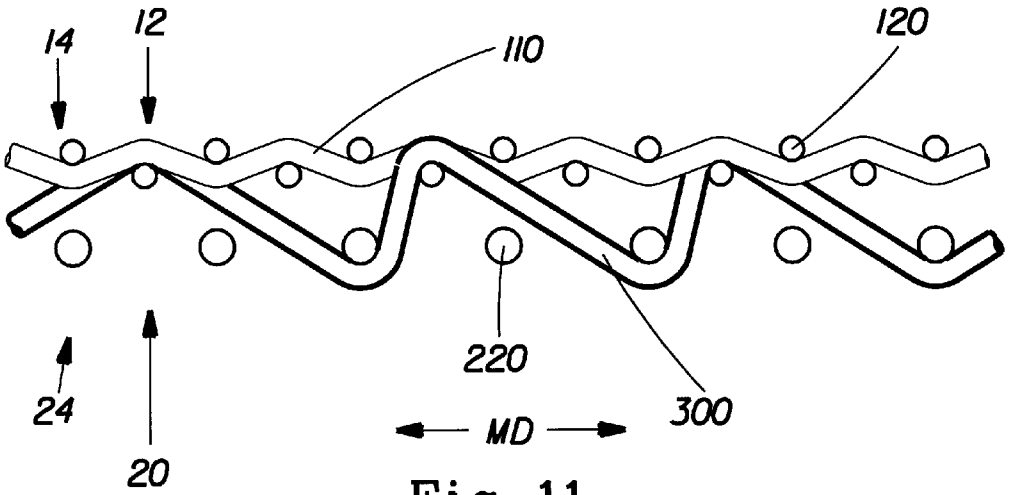
FIG. 11 is a vertical cross-sectional view similar to the view shown in FIG. 10, showing still another embodiment of the bottom-integral tie yarn forming a "one-over/three-under" repeating pattern of the tie layers interwoven with the top layer.

One of ordinary skill in the art will recognize that the "one-over/seven-under" pattern of the weave of the tie yarns 300 with the top layer 12 is one preferred, but not necessary, embodiment of the belt 10 of the present invention. For example, FIG. 10 shows a "one-over/five-under" pattern; and FIG. 11 shows a "one-over/three-under" pattern of the weave of the tie yarns 300 with the top layer 12. The examples shown in FIGS. 1–12 are presented for the purposes of illustration only, and not for the purposes of limitation.

As has been noted above, the preferred embodiment of the belt 10 is in the form of an endless belt. Therefore, it should be recognized that, as used herein, the terms "over," "above," "under," "underneath" are relative terms, the descriptive meanings of which are consistent with the descriptive meanings of the terms "top layer 12" and "bottom layer 20" of the belt 10 as it is shown in cross-sectional views represented in FIGS. 2–11 and used in its normal and ordinary position on a papermaking machine.

Referring back to FIG. 1, as each tie yarn 300 passes, or weaves, over at least one of the top layer cross-carrier yarns 120, each tie yarn 300 bilaterally alternates about at least one of the top layer carrier yarns 110. As FIG. 1 shows, each tie yarn 300 bilaterally alternates about one corresponding top layer carrier yarn 110 in the direction of the top layer cross-carrier yarns 120. In the preferred embodiment, at the point where the tie yarn 300 passes over the top layer cross-carrier yarn 120, the tie yarn 300 reaches its maximum of bilateral alternation. As used herein, the term "maximum of bilateral alternation" refers to the greatest deviation of the tie yarn 300 from the longitudinal axis of the corresponding carrier yarn 110, as measured in the plane of the belt 10. A "corresponding" carrier yarn (or simply, a corresponding yarn) is the carrier yarn about which the tie yarn 300 alternates in the plane of the belt 10. It should be carefully noted that the corresponding yarn may be an inherent element of the weave of the top layer 12, the bottom layer 20, or both—the top layer 12 and the bottom layer 20. As a result of the bilateral alternation, each tie yarn 300 forms an undulating line passing completely underneath the top layer carrier yarn 110 at spaced intervals intermediate two adjacent maxima of bilateral alternation of this tie yarn 300. It should be noted that when the tie yarns 300 pass over the top layer cross-carrier yarns 120, the tie yarns 300 preferably do not extend above the top layer carrier yarns 110, and therefore do not interfere with the preferred flat-woven character of the web facing side 14 of the belt 10.

FIGS. 1 and 1A show two different overall patterns of distribution of the maxima of bilateral alternation of the tie yarns 300. FIG. 1 represents an overall pattern having concentrated zones of the maxima of bilateral alternation (running "diagonally" relative to the machine direction in FIG. 1). FIG. 1A shows an overall pattern having the maxima of bilateral alternation which is less concentrated than the pattern shown in FIG. 1. The overall pattern of FIG. 1A is preferred, because it provides a more even and homogeneous distribution of occluded areas created at and around the points of the maxima of bilateral alternation of tie yarns 300.

The overall pattern shown in FIG. 1A is represented for the purposes of illustration and not for the purposes of limitation. One skilled in the art will readily understand that other overall patterns of distribution of the maxima of bilateral alternation of the tie yarns 300, providing an even distribution of the maxima of bilateral alternation of tie yarns 300 throughout the belt 11 may be utilized. For example, a non-uniform overall pattern (not shown) may be utilized, in which the maxima of bilateral alternation are distributed in a non-repeating, or even disorderly, manner.

Preferably, every tie yarn 300 is in direct contact with its corresponding carrier yarn 110 at the point where the tie yarn 300 reaches its maximum of bilateral alternation. Therefore, the corresponding carrier yarns 110 do not let the tie yarns 300 to stretch into a completely straight line and to become parallel to the carrier yarns 110 between two adjacent maxima of bilateral alternation even if the tie yarns 300 are pre-stretched in the machine direction. The specific weave of the belt 10 of the present invention results in the tie yarns 300 forming the undulating lines. Therefore, there is no need in a special pre-treatment of the tie yarns 300 (for example, chemical treatment or thermosetting) for the purposes of making the tie yarns 300 form the undulating lines.

While the tie yarns 300 are preferably never parallel to their corresponding top layer carrier yarns 110 between two adjacent maxima of bilateral alternation, it should be carefully noted that the tie yarns 300 have the same general direction as the top layer carrier yarns 110, as has been indicated hereabove and shown in FIG. 1. As used herein, the term "general direction" designates a direction of the tie yarns 300 that occurs throughout a series of at least four consecutive maxima of bilateral alternation.

With regard to the bottom layer 20, FIGS. 3, 7, 8, 9, 10, 11 represent different embodiments of the belt 10 of the present invention. First, it should be noted that the tie yarns 300 may comprise adjunct tie yarns 330. Alternatively, the tie yarns 300 may comprise integral tie yarns 350. As used herein, the tie yarn 300 is considered to be an "adjunct tie yarn" 330 if it is not inherent in the weave selected for either one of the top layer 12 or the bottom layer 20. That is to say, the top layer 12 and the bottom layer 20 exist as independent structures of interwoven top layer yarns 100 and the interwoven bottom layer yarns 200 respectively, regardless of the existence of the adjunct tie yarns 330. The adjunct tie yarns 330 are used only for the purpose of joining the top layer 12 and the bottom layer 20 together and may even disrupt the ordinary weave of these top and bottom layers 12, 20. Preferably, the adjunct tie yarns 330 are smaller in cross-sectional area than the top layer yarns 100 and the bottom layer yarns 200.

As used herein, the tie yarn 300 is considered to be an "integral tie yarn" 350 if it is an inherent element of the weave of the top layer 12, the bottom layer 20, or both the top layer 12 and the bottom layer 20. The integral tie yarn 350 is a "bottom-integral tie yarn" if it is an inherent element of the weave of the bottom layer 20 and only occasionally passes over the top cross-carrier yarn 120. The integral tie yarn 300 is a "top-integral tie yarn" if it is an inherent element of the weave of the top layer 12 and occasionally passes under the bottom cross-carrier yarn 220. FIGS. 8, 9 show two embodiments of the belt 10 of the present invention having the preferred bottom-integral tie yarns 352. In both embodiments shown in FIGS. 8 and 9, the bottom layer 20 is comprised of the bottom-integral tie yarns 350 which are interwoven with the bottom layer cross-carrier yarns 220. In both embodiments shown in FIGS. 8 and 9, the bottom-integral tie yarns 350 function also as (and in fact are) the bottom layer carrier yarns 210.

It will be apparent to one skilled in the art that in the belt 10 having the top-integral tie yarns 350, the top layer 12 is comprised of the top-integral tie yarns 350 interwoven with the top layer cross-carrier yarns 120. In this case, the top-integral tie yarns 350 also function as the top layer carrier yarns 120. The latter embodiment is not illustrated, but may be easily envisioned by turning FIGS. 8, 9 upside down. In this case, as each top integral tie yarn 350 passes under or over at least one of the bottom layer cross-carrier yarns 220, each top-integrated tie yarn 350 bilaterally alternates about at least one of the bottom layer carrier yarns 210. As a result of this bilateral alternation, each top-integral tie yarn 350 forms an undulating line passing completely over or underneath the bottom layer carrier yarn 110 at spaced intervals intermediate two adjacent maxima of bilateral alternation of the top-integral tie yarn 350.

One skilled in the art will recognize that a variety of possible patterns of the tie yarns 300 interwoven with the top layer 12 and the bottom layer 20 of the belt 10 may be utilized. Some of these patterns are shown in FIGS. 3, 7, 8, 9, 10, 11. FIGS. 3, 7 represent the belt 10 having the adjunct tie yarns 330, while FIGS. 8–11 represent the belt 10 having the integral tie yarns 350. FIG. 3 shows the typical embodiment of the belt 10 comprising the adjunct tie yarns 330. In the belt 10 shown in FIG. 3, the adjunct tie yarn 330 is interwoven with the top layer 12 according to the pattern "one-over/seven-under" described hereabove. The adjunct tie yarn 330 is interwoven with the bottom layer 20 according to the similar pattern "seven-over/one-under." The bottom layer cross-carrier yarn 220 under which the adjunct tie yarn 330 passes while running under seven top layer cross-carrier yarns 120, is disposed intermediate two adjacent top layer cross-carrier yarns 120 over which the adjunct tie layer 330 passes. As FIG. 3 shows, most of the length of the adjunct tie yarn 330 is disposed between the top layer 12 and the bottom layer 20.

Other embodiments of the belt 10 of the present invention are feasible, given the various combinations of the top/bottom layer vs. adjunct/ integrated tie yarns and permutations of the foregoing teachings. The described combinations are not intended to limit the present invention to only those that are described and shown above.

Figure 12A:
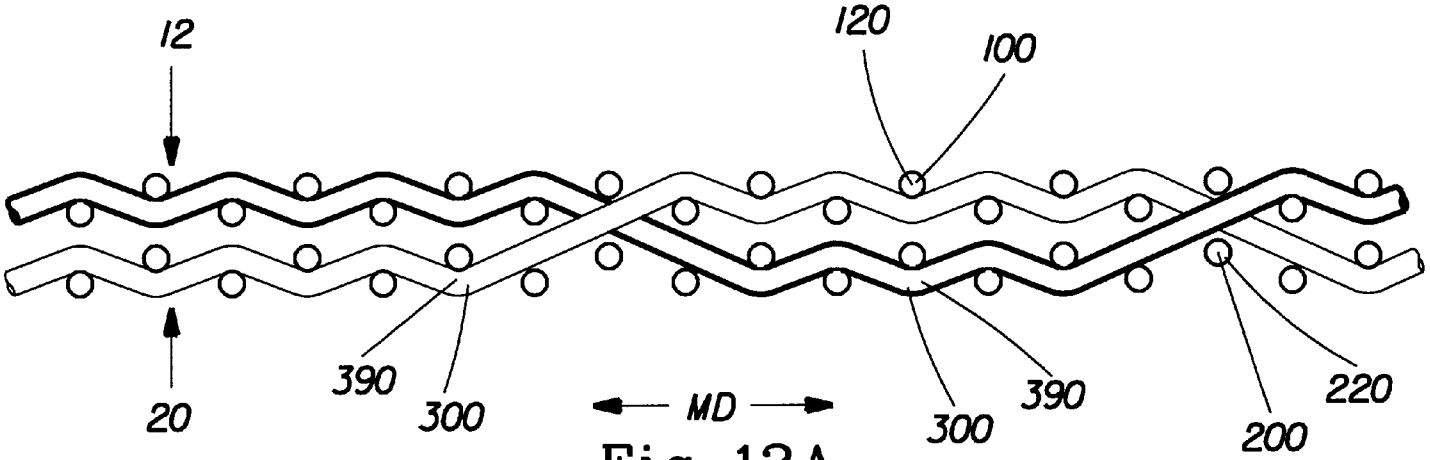
FIG. 12A is a schematic cross-sectional view of the papermaking fabric having top/bottom-integral tie yarns.
Figure 12B:
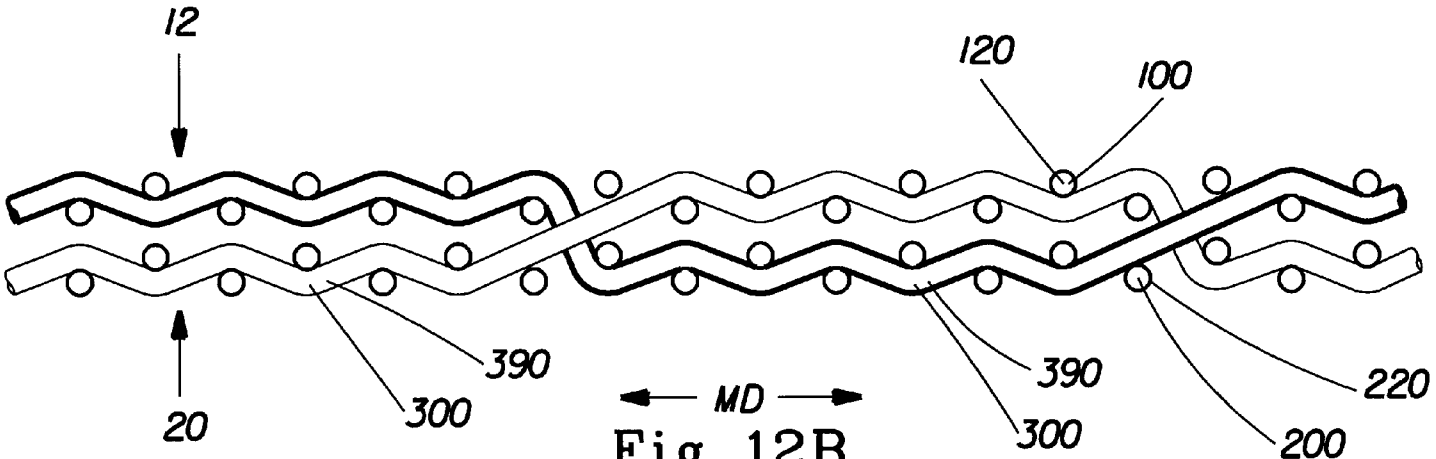
FIG. 12B is a view similar to FIG. 12A showing another embodiment of the papermaking fabric having top/bottom-integral tie yarns.

For example, FIGS. 12A and. 12B schematically illustrate two embodiments of the belt 10 in which the tie yarn 300 comprises a top/bottom-integral tie yarn 390. As the term suggests, the top/bottom-integral tie yarn 390 is an inherent element of the weave of both the top layer 12 and the bottom layer 20. In this case, the plurality of top layer carrier yarns 110 and the plurality of bottom layer carrier yarns comprise a plurality of the top/bottom-integral tie yarns 390. When the carrier yarns 110, 210 are oriented in the machine direction, the top/bottom-integral tie yarns 390 are the machine direction top/bottom-integral tie yarns 390, as shown in FIGS. 12A and 12B. By analogy, when the carrier yarns 110, 210 are oriented in the cross-machine direction, the top/bottom integral tie yarns 390 are the cross-machine direction top/bottom-integral tie yarns 390 (not shown).

As FIGS. 12A and 12B show the top layer 12 and the bottom layer 20 are tied together in a substantially parallel and interfacing relationship by the machine direction top/bottom-integral tie yarns 390. These machine direction top/bottom-integral tie yarns 390 pass over some of the cross-machine direction top layer yarns 120 and under some of the cross-machine direction bottom layer yarns 220 in a repeating pattern and at spaced intervals such that as each of the machine direction top/bottom-integral tie yarns 390 passes over at least one of the cross-machine direction top layer yarns 120 and under at least one of the cross-machine direction bottom layer yarns 220, each of the machine direction top/bottom-integral tie yarns 390 bilaterally alternates in the cross-machine direction about at least one (corresponding) machine direction top layer yarn 110 and about at least one (corresponding) machine direction bottom layer yarn 210. (Yarns 110 and 120 are not shown in FIGS. 12A and 12B for clarity.) As a result of this bilateral alternation, each of the machine direction top/bottom-integral tie yarns 390 forms an undulating line having a general machine direction and passing completely underneath the corresponding machine direction top layer yarn 110 and completely over the corresponding machine direction bottom layer yarn 210 at spaced intervals intermediate two adjacent maxima of bilateral alternation of each of the machine direction tie/bottom-integral tie yarns 390.

It is important, especially in the case of through-air-drying, that the belt 10 of the present invention allow sufficient air flow perpendicular to the plane of the belt 10. Preferably, the air permeability of the belt 10 (having no resinous framework 40 thereupon) of the present invention is greater than 500 standard cubic feet per minute (cfm) per square foot of its surface at a pressure differential of 100 Pascals. More preferably, the belt 10 (having no resinous framework 40 thereupon) has the air permeability greater than 800 cfm at 100 Pascals.

Figure 13:
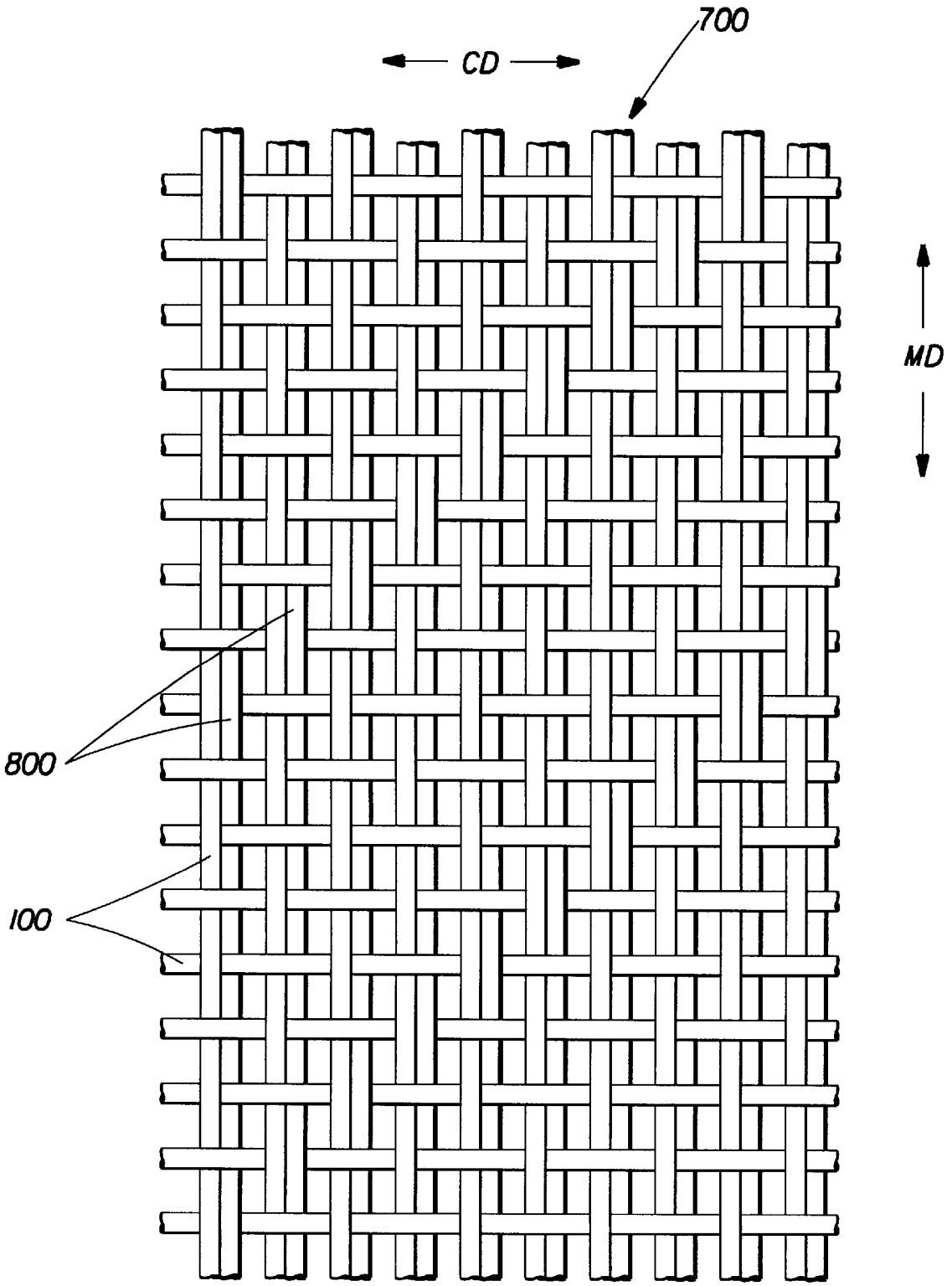
Fig. 13 Prior Art
FIG. 13 is a plan view of the papermaking papermaking fabric of the prior art, showing non-alternating tie yarns.

While not intended to be bound by theory, it is believed that the belt 10 of the present invention having bilaterally alternating tie yarns provides the increased air permeability compared with the similar belt having non-alternating tie yarns. FIG. 13 illustrates the prior art and shows the belt 700 having non-alternating tie yarns 800. As FIG. 13 shows, the non-alternating tie yarns 800 of the prior art substantially reduce the belt's projected open areas between the mutually perpendicular interwoven yarns 100, 200. In the present invention, the tie yarns 300, by virtue of their bilateral alternation, minimize reduction of the open area of the belt 10 and therefore minimize interference with the air flow through the belt 10.

Two two-layer belts—first, the belt 10 of the present invention, having the alternating tie yarns, and the second, the belt 700 of the prior art, having non-alternating tie yarns—are being compared. Both belts 10 and 700 have the following characteristics:

- the diameter of the top layer carrier yarns is 0.15 mm,
- the number of the top layer carrier yarns is 45 yarns per inch,
- the diameter of the top layer cross-carrier yarns is 0.15 mm,
- the number of the top layer cross-carrier yarns is 48 yarns per inch;
- the diameter of the bottom layer carrier yarns (bottom-integral tie yarns) is 0.15 mm;
- the number of the bottom layer carrier yarns (bottom-integral tie yarns) is 45 yarns per inch,
- the diameter of the bottom layer cross-carrier yarns is 0.20 mm,
- the number of the bottom layer cross-carrier yarns is 24 yarns per inch.

Both belts 10 and 700 have the one-over/one-under inherent weave of the top and bottom layers and the "one-over/seven-under" weave of the bottom-integral tie yarns described hereabove. Both belts 10 and 700 have the similar overall pattern of locations where the tie yarns pass over the top layer cross-carrier yarns, as shown in FIGS. 1 and 13, respectively (in the case of the belt 10 of the present invention, these locations comprise maxima of bilateral alternation of the tie yarns).

Presumptively, because of the use of the identical fibers and the weave patterns in both belts, both belts have about the same fiber support. It is believed that the use of the alternating tie yarns in the first belt 10 made according to the present invention increases the projected open area at least about 15%, compared to the projected open area of the second belt 700 having the non-alternating tie yarns of the prior art.

At the same time, the use of alternating tie yarns 300 according to the present invention provides the necessary fiber support. As used herein, the "fiber support," and especially, its physical characteristic "Fiber Support Index," is defined in Robert L. Beran, "The Evaluation and Selection of Forming Fabrics," *Tappi* /April 1979, Vol. 62, No. 4, which is incorporated by reference herein. As has been shown hereabove, a trade-off exists between the air permeability and the fiber support of the papermaking belt. Therefore, if the belts 10 and 700 are prophetically rewoven to be compared on the basis of the same air permeability (or the same projected open area), the use of the alternating yarns in the belt 10 of the present invention increases the Fiber Support Index more than about 20%, compared to the belt 700 of the prior art having about the same projected open area but non-alternating tie yarns.

The yarns 100, 200, 300 may have a variety of cross-sectional shapes, including but not limited to circles, ovals, rectangles, and other polygons. For example, the top layer yarns 100 and the bottom layer yarns 200 may have cross-sectional areas shaped as circles of equal or unequal diameters, while the tie yarns 300 may be flat. In any case, the cross-sectional area of the bottom yarns 200 may be greater than the cross-sectional area of the top yarns 100. It follows, the cross-sectional area of the top yarns 100 may be greater than the cross-sectional area of the tie yarns 300.

Generally, the yarns 100, 200, 300 of the papermaking belt of the present invention may be produced from a wide specter of synthetic resins. When used in a through-air-drying belt, the preferred material of the yarns 100, 200, 300 of the belt 10 is Poly (ethylene terephthalate).

While the present invention has been discussed and the FIGS. 1–12 have been presented in terms of monofilament yarns, one skilled in the art will recognize that the yarns 100, 200, 300 may comprise multifilament yarns and plied monofilament yarns.

The papermaking fabric of the present invention can be made using a conventional weaving technique and conventional weaving equipment. Alteratively, the papermaking fabric can be made by hand.

Figure 14:
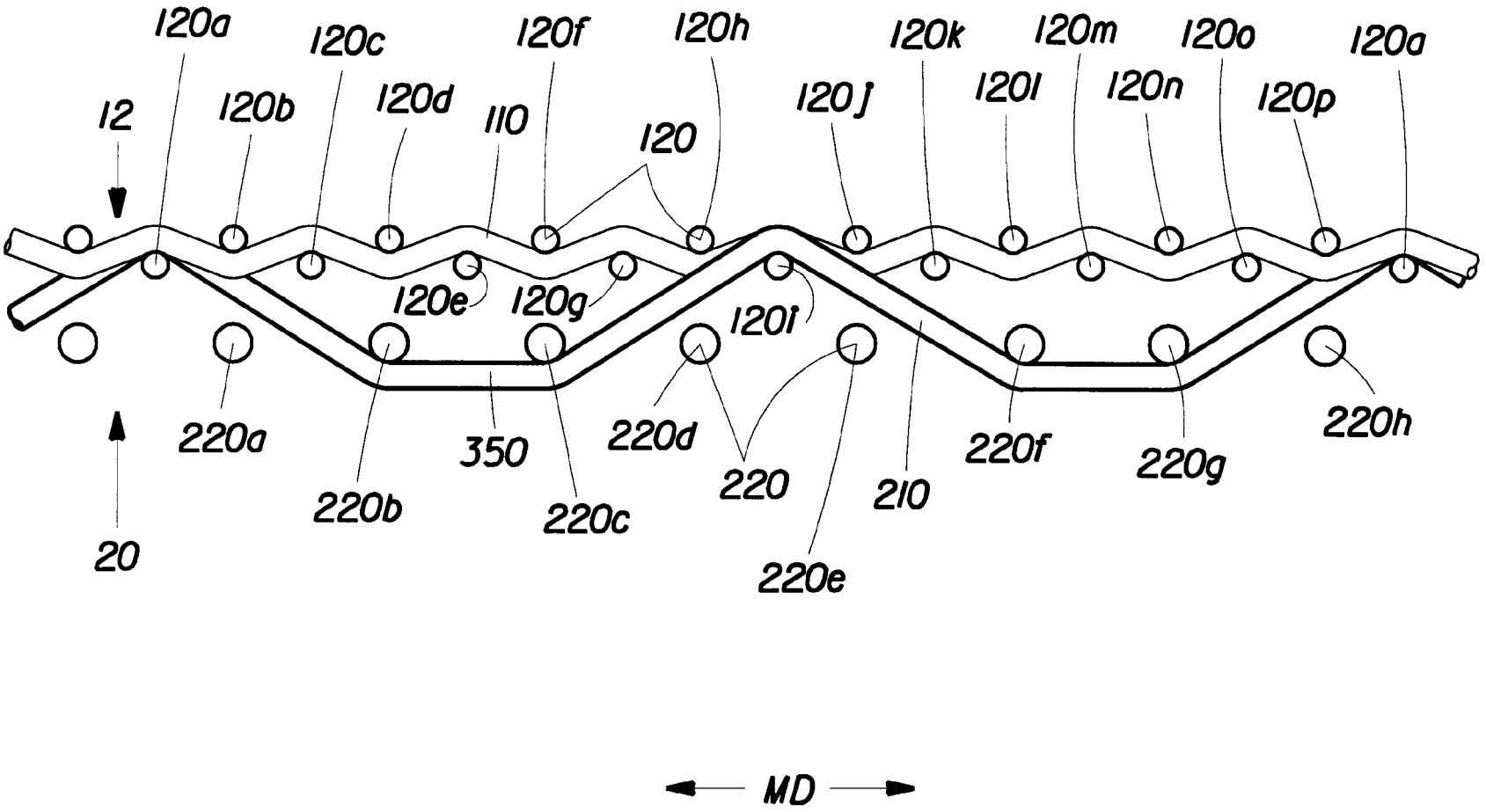
FIG. 14 is a vertical cross sectional view similar to that shown in FIG. 9, and showing a complete repeating pattern of bilateral alternation of a tie yarn.

FIG. 14 is used herein as a reference to describe a step-by-step process of weaving by hand of the papermaking fabric. In an exemplary pattern shown in FIG. 14, MD yarns are designated by the numerals 110 and 350, and CD yarns are designated by the generic numerals 120 and 220. For the convenience of describing the process of weaving, the individual top-layer CD yarns are designated as 120*a*, 120*a*, 120*c*, . . . , and so on, in alphabetic order; and the individual bottom-layer CD: yarns are designated as 220*a*, 220*b*, 220*c*, . . . , and so on, in alphabetic order. In FIG. 14, the tie yarns comprise the MD bottom-layer integral tie yarns 350.

First, a plurality of MD yarns and CD yarns is provided. The MD yarns are placed in the machine direction. Then, the weaving process comprises the following steps (described here in below in the form of the instructions, with reference to FIG. 14). For convenience, the description of the process starts just prior to the point when the tie yarn 360 reaches its maximum of bilateral alternation, which point is adjacent to the yarn 120*a* (at the left-hand side of FIG. 14).

(1) Raise MD yarn 110 and raise MD tie yarn 350. Place CD yarn 120*a* below tie yarn 350 and below yarn 110.

(2) Lower MD tie yarn 350, and lower MD yarn 110. Place CD yarn 120*b* above tie yarn 350 and above yarn 110.

(3) Raise MD tie yarn 350, and raise MD yarn 110. Place CD yarn 220*a* below tie yarn 350 and below yarn 110.

(4) Lower MD tie yarn 350, and raise MD yarn 110. Place CD yarn 120*c* above tie yarn 350 and below yarn 110.

(5) Lower MD tie yarn 350, and lower MD yarn 110. Place CD yarn 120*d* above tie yarn 350 and above yarn 110.

(6) Lower MD tie yarn 350, and raise MD yarn 110. Place CD yarn 220*b* above tie yarn 350 and below yarn 110.

(7) Lower MD tie yarn 350, and raise MD yarn 110. Place CD yarn 120*e* above tie yarn 350 and below yarn 110.

(8) Lower MD tie yarn 350, and lower MD yarn 110. Place CD yarn 12O*f* above tie yarn 350 and above yarn 110.

(9) Lower MD tie yarn 350, and raise MD yarn 110. Place CD yarn 220*c* above tie yarn 350 and below yarn 110.

(10) Lower MD tie yarn 350, and raise MD yarn 110. Place CD yarn 120*g* above tie yarn 350 nd below yarn 110.

(11) Lower MD tie yarn 350, and lower MD yarn 111. Place CD yarn 120*h* above tie yarn 350 and above yarn 11.

(12) Raise MD tie yarn 350, and raise MD yarn 110. Place CD yarn 220*d* below tie yarn 350 and below yarn 110.

(13) Switch MD tie yarn 350 and MD yarn 110 in plan, i.e., "alternate" MD tie yarn 350 about MD yarn 110 in the cross-machine direction.

(14) Raise MD tie yarn 350, and raise MD yarn 110. Place CD yarn 120*i* below tie yarn 350 and below yarn 110. (At this point, tie yarn 350 reaches its maximum of bilateral alternation.)

(15) Lower MD tie yarn 350, and lower MD yarn 10. Place CD yarn 120*j* above tie yarn 350 and above yarn 110.

(16) Raise MD tie yarn 350, and raise MD yarn 110. Place CD yarn 220*e* below tie yarn 35 and below yarn 110.

(17) Lower MD tie yarn 350, and raise MD yarn 11O. Place CD yarn 120*k* above tie yarn 35 and below yarn 110.

(18) Lower MD tie yarn 350, and lower MD yarn 110. Place CD yarn 1201 above tie yarn 360 and above yarn 110.

(19) Lower MD tie yarn 350, and raise MD yarn 110. Place CD yarn 220*f* above tie yarn 350 and below yarn 110.

(20) Lower MD tie yarn 350, and raise MD yarn 110. Place CD yarn 120*m* above tie yarn 350 and below yarn 110.

(21) Lower MD tie yarn 350, and lower MD yarn 110. Place CD yarn 120*n* above tie yarn 350 and above arn 11O.

(22) Lower MD tie yarn 350, and raise yarn 110. Place CD yarn 220*g* above tie yarn 350 and below yarn 110.

(23) Lower MD tie yarn 350, and raise D yarn 110. Place CD yarn 120*o* above tie yarn 350 and below yarn 110.

(24) Lower MD tie yarn 350, and lower MD yarn 110. Place CD yarn 120*p* above tie yarn 350 and above yarn 110.

(25) Raise MD tie yarn 350, and raise MD yarn 110. Place CD yarn 220*h* below tie yarn 350 and below yarn 110.

(26) Switch back MD tie yarn 350 and MD yarn 110 in plan, i.e., "alternate" MD tie yarn 350 about MD yarn 110 in the cross-machine direction.

Thereafter, the process continues fro the step 1 ), ad described herein above.

What is claimed is:

1. A papermaking belt comprising:

a top layer of interwoven top layer yarns, said top layer yarns comprising a plurality of top layer carrier yarns interwoven in a weave with a plurality of top layer cross-carrier yarns, said top layer carrier yarns being substantially perpendicular to said top layer cross-carrier yarns;

a bottom layer of interwoven bottom layer yarns, said bottom layer yarns comprising a plurality of bottom layer carrier yarns interwoven in a weave with a plurality of bottom layer cross-carrier yarns, said bottom layer carrier yarns being substantially perpendicular to said bottom layer cross-carrier yarns;

said top layer and said bottom layer being tied together in a substantially parallel and interfacing relationship by a plurality of tie yarns having a general direction substantially parallel to said top layer carrier yarns and said bottom layer carrier yarns, said tie yarns passing over said top layer cross-carrier yarns and under said bottom layer cross-carrier yarns at spaced intervals in a repeating pattern such that as each of said tie yarns passes over at least one of said top layer cross-carrier yarns and under at least one of said bottom layer cross-carrier yarns, each of said tie yarns bilaterally alternating about at least one of said top layer carrier yarns or at least one of said bottom layer carrier yarns in the direction of said cross-carrier yarns whereby said each of said tie yarns forms an undulating line passing completely underneath said at least one of said top layer carrier yarns or completely over said at least one of said bottom carrier yarns at spaced intervals intermediate two adjacent maxima of bilateral alternation of said tie yarn.

2. A belt according to claim 1, wherein said general direction of said plurality of tie yarns is substantially parallel to a machine direction.

3. A belt according to claim 2, wherein the cross-sectional area of said tie yarns is less than the cross-sectional area of said top layer yarns.

4. A belt according to claim 3, wherein the cross-sectional area of said tie yarns is less than the cross-sectional area of said bottom layer yarns.

5. A belt according to claim 2, wherein said plurality of tie yarns comprises adjunct tie yarns.

6. A belt according to claim 2, wherein said plurality of tie yarns comprises integral tie yarns.

7. A belt according to claim 6, wherein said plurality of tie yarns comprises said bottom layer yarns.

8. A belt according to claim 7, wherein said plurality of tie yarns further comprises said top layer yarns.

9. A belt according to claim 6, wherein said plurality of tie yarns comprises said top layer yarns.

10. A belt according to claim 1, wherein said general direction of said plurality of tie yarns is substantially parallel to a cross-machine direction.

11. A belt according to claim 10, wherein said plurality of tie yarns comprises adjunct tie yarns.

12. A belt according to claim 10, wherein said plurality of tie yarns comprises integral tie yarns.

13. A belt according to claim 12, wherein said plurality of tie yarns comprises said bottom layer yarns.

14. A belt according to claim 13, wherein said plurality of tie yarns further comprises said top layer yarns.

15. A belt according to claim 12, wherein said plurality of tie yarns comprise said top layer yarns.

16. A papermaking belt according to claim 1, further comprising a framework joined to said belt and extending outwardly from a web-facing side of said top layer to form a web-contacting surface.

17. papermaking belt comprising:

a top layer of interwoven top layer yarns, said top layer yarns comprising a plurality of machine direction top layer yarns interwoven in a weave with a plurality of cross-machine direction top layer yarns, said cross-machine direction top layer yarns being substantially perpendicular to said machine direction top layer yarns;

a bottom layer of interwoven bottom layer yarns, said bottom layer yarns comprising a plurality of machine direction bottom layer yarns interwoven in a weave with a plurality of cross-machine direction bottom layer yarns, said cross-machine direction bottom layer yarns being substantially perpendicular to said machine direction bottom layer yarns;

said top layer and said bottom layer being tied together in a substantially parallel and interfacing relationship by a plurality of machine direction tie yarns passing over said cross-machine direction top layer yarns and under said cross-machine direction bottom layer yarns at spaced intervals in a repeating pattern such that as each of said machine direction tie yarns passes over at least one of said cross-machine direction top layer yarns and under at least one of said cross-machine direction bottom layer yarns, said each of said machine direction tie yarns bilaterally alternates about at least one of said machine direction top layer yarns and at least one of said machine direction bottom layer yarns in the cross-machine direction, whereby said each of said machine direction tie yarns forms an undulating line passing completely underneath said at least one of said machine direction top layer yarns at spaced intervals intermediate two adjacent maxima of bilateral alternation of said each of said machine direction tie yarns.

18. A papermaking belt comprising:

a top layer of interwoven top layer yarns, said top layer yarns comprising a plurality of machine direction top layer yarns interwoven in a weave with a plurality of cross-machine direction top layer yarns, said cross-machine direction top layer yarns being substantially perpendicular to said machine direction top layer yarns;

a bottom layer of interwoven bottom layer yarns, said bottom layer yarns comprising a plurality of machine direction tie yarns interwoven in a weave with a plurality of cross-machine direction bottom layer yarns, said cross-machine direction bottom layer yarns being substantially perpendicular to said machine direction tie yarns;

said top layer and said bottom layer being tied together in a substantially parallel and interfacing relationship by said plurality of machine direction tie yarns passing over said cross-machine direction top layer yarns at spaced intervals in a repeating pattern such that as each of said machine direction tie yarns passes over at least one of said cross-machine direction top layer yarns, said each of said machine direction tie yarns bilaterally alternates about a corresponding machine direction top layer yarn in the cross-machine direction, whereby said each of said machine direction tie yarns forms an undulating line passing completely underneath said corresponding machine direction top layer yarn at spaced intervals intermediate two adjacent maxima of bilateral alternation of said each of said machine direction tie yarns.

19. A papermaking belt according to claim 16, further comprising a framework joined to said belt and extending outwardly from a web-facing side of said top layer to form a web-contacting surface.

20. A papermaking belt comprising:

a top layer of interwoven top layer yarns, said top layer yarns comprising a plurality of machine direction top layer yarns interwoven in a weave with a plurality of cross-machine direction top layer yarns, said cross-machine direction top layer yarns being substantially perpendicular to said machine direction top layer yarns;

a bottom layer of interwoven bottom layer yarns, said bottom layer yarns comprising a plurality of machine direction bottom layer yarns interwoven in a weave with a plurality of cross-machine direction bottom layer yarns, said cross-machine direction bottom layer yarns being substantially perpendicular to said machine direction top layer yarns, said plurality of machine direction top layer yarns and said plurality of machine direction bottom layer yarns comprising a plurality of machine direction top/bottom-integral tie yarns;

said top layer and said bottom layer being tied together in a substantially parallel and interfacing relationship by said plurality of machine direction top/bottom-integral tie yarns passing over said top layer yarns and under said bottom layer yarns at spaced intervals in a repeating pattern such that as each of said plurality of machine direction top/bottom-integral tie yarns passes over at least one of said cross-machine direction top layer yarns or under at least one of said cross-machine direction bottom layer yarns, each of said machine direction top/bottom-integral tie yarns bilaterally alternates in the cross-machine direction about a corresponding machine direction top layer yarn or about a corresponding machine direction bottom layer yarn, whereby each of said machine direction top/bottom-integral tie yarns forms an undulating line passing completely underneath said corresponding machine direction top layer yarn or completely over said corresponding machine direction bottom layer yarn at spaced intervals intermediate two adjacent maxima of bilateral alternation of said each of said machine direction tie/bottom-integral tie yarns.

* * * * *

UNITED STATES PATENT AND TRADEMARK OFFICE

CERTIFICATE OF CORRECTION

PATENT NO. : 5,954,097
DATED : September 21, 1999
INVENTOR(S) : Glenn David Boutilier It is certified that error appears in the above-identified patent and that said Letters Patent is hereby corrected as shown below:

Title page,
"References Cited", second column, "5,482,566" should read -- 5,482,567 --.

Column 1,
Line 6, "bets" should read -- fabrics --.

Column 9,
Line 25, "and." should read -- and --.
Line 31, after "yarns" insert -- 210 --.
Line 40, after "show" insert -- , --.

Column 11,
Line 32, "Alteratively," should read -- Alternatively, --.
Line 40, "120a, 120a," should read -- 120a, 120b, --.
Line 48, "here in" should read -- herein --.
Line 51, "when" should read -- where --.
Line 51, "360" should read -- 350 --.

Column 12,
Line 4, "12Of" should read -- 120f --.
Line 9, "nd" should read -- and --.
Line 11, "111." should read -- 110. --.
Line 13, "11." should read -- 110. --.
Line 27, "35" should read -- 350 --.
Line 29, "35" should read -- 350 --.
Line 32, "360" should read -- 350 --.

UNITED STATES PATENT AND TRADEMARK OFFICE

CERTIFICATE OF CORRECTION

PATENT NO. : 5,954,097
DATED : September 21, 1999
INVENTOR(S) : Glenn David Boutilier It is certified that error appears in the above-identified patent and that said Letters Patent is hereby corrected as shown below:

Column 12, cont'd,
Line 41, "arn" should read -- yarn --.
Line 42, "11O." should read -- 110. --.
Line 45, "D" should read -- MD --.
Line 55, "fro" should read -- from --.
Line 55, "1), ad" should read -- (1), and --.

Signed and Sealed this

Sixth Day of November, 2001

*Attest:*

Nicholas P. Godici

NICHOLAS P. GODICI
*Acting Director of the United States Patent and Trademark Office*

*Attesting Officer*